US007450881B2

(12) United States Patent
Kenji et al.

(10) Patent No.: US 7,450,881 B2
(45) Date of Patent: Nov. 11, 2008

(54) FINISHING APPARATUS OF IMAGE FORMING APPARATUS

(75) Inventors: Umehara Kenji, Tokyo (JP); Jeong-Ho Kim, Seoul (KR); Yeon-Kawan Chung, Seoul (KR); Seong-Kyoon Noh, Seoul (KR); Jae-Geol Choi, Seoul (KR)

(73) Assignees: KRDC Co., Ltd., Seoul (KR); Gradco (Japan) Ltd., Tokyo (JP)

( * ) Notice: Subject to any disclaimer, the term of this patent is extended or adjusted under 35 U.S.C. 154(b) by 1143 days.

(21) Appl. No.: 10/259,487

(22) Filed: Sep. 30, 2002

(65) Prior Publication Data

US 2003/0198494 A1 Oct. 23, 2003

(30) Foreign Application Priority Data

Apr. 18, 2002 (KR) ..... 2002-21199
May 10, 2002 (KR) ..... 2002-25726

(51) Int. Cl.
*G03G 21/00* (2006.01)

(52) U.S. Cl. ..... 399/110; 399/12; 399/407

(58) Field of Classification Search ..... None
See application file for complete search history.

(56) References Cited

U.S. PATENT DOCUMENTS 5,080,340 A * 1/1992 Hacknauer et al. ..... 270/37
5,172,162 A * 12/1992 Taneda ..... 399/408
5,390,910 A * 2/1995 Mandel et al. ..... 271/296
5,777,882 A * 7/1998 Salgado ..... 271/298
5,978,621 A * 11/1999 Glemser et al. ..... 399/407
6,004,254 A 12/1999 Murata
6,125,305 A * 9/2000 Sugita et al. ..... 700/213
6,349,243 B1 * 2/2002 Takagi ..... 700/223

* cited by examiner

*Primary Examiner*—Jill E. Culler
(74) *Attorney, Agent, or Firm*—Greenblum & Bernstein, P.L.C.

(57) ABSTRACT

A finishing apparatus of an image forming apparatus and a method for controlling the same are disclosed, in which various block modules performing finishing functions are provided and a user can selectively use any module by detachably fixing the same in a copier. The finishing apparatus includes a paper conveyer module detachably fixed to an image tray module, a mail box module, a finisher module, and a booklet module, the paper conveyer module being detachably fixed in a copier. The paper conveyer module includes a controller sensing whether the respective modules are detachably provided to selectively control functions of the respective modules in accordance with an output signal of the copier. In addition, paper path switch devices provided in the paper conveyer module include a plurality of paper dispensers that dispense papers in three or more directions.

12 Claims, 18 Drawing Sheets

FINISHING APPARATUS OF IMAGE FORMING APPARATUS

BACKGROUND OF THE INVENTION

1. Field of the Invention

The present invention relates to a finishing apparatus of an image forming apparatus such as a printer, a copier, and a printer, and more particularly to a finishing apparatus of an image forming apparatus and a method for controlling the same, in which a mail box module, a finisher module, a booklet module, and an image tray module are detachably provided in the image forming apparatus to allow a user to selectively use them.

2. Discussion of the Related Art

An example of a related art finishing apparatus is disclosed in U.S. Pat. No. 6,004,254.

The related art finishing apparatus will be described with reference to FIG. 15.

Referring to FIG. 15, a reference numeral 1 denotes an image forming apparatus (copier), and a reference numeral 2 denotes a finishing apparatus.

The finishing apparatus 2 includes an image tray 5 and a booklet 6 which are fixed to each other to form a single body, and is fixed to a side part of the copier 1.

The image tray 5 is to directly stack papers finished through the copier 1 onto a stack tray 7. The booklet 6 is to stack the papers onto an eject tray 35 after binding the papers.

The papers move to the image tray 5 and the booklet 6 under the control of a paper path switch device 3 that acts as a paper dispensing means. The papers moved to the booklet 6 are bound by action of a stapler unit 18, a folding roller 26, and a paper positioning unit 23 in the booklet 6. The bound papers are ejected onto the eject tray 35.

The image tray 5 and the booklet 6 of the related art finishing apparatus 2 are formed in a single body without being detached from each other. Particularly, since the image tray module and the booklet module cannot be detached from each other on the main body of the copier, a user cannot freely set a desired function of the module, thereby failing to construct a finishing apparatus suitable for the desired function.

Also, since the user cannot freely expand a specific module to stack finished papers, efficiency of the apparatus is reduced.

Furthermore, if a module for performing an additional function is provided in the finishing apparatus, it is not easy to mount the module in the finishing apparatus and to remove the papers when the papers are caught in the finishing apparatus.

In the paper path switch device 3, if a flap 305*a* is in contact with a paper moving path plane 307*a* as shown in FIG. 14*a*, the papers move upwardly. If a flap 305*b* is in contact with a path plane 307*b* as shown in FIG. 15, the papers move in a left direction under the guide of the flaps 305*a* and 305*b*. A reference numeral 308 denotes a paper moving roller which is provided on the paper moving path plane to facilitate movement of the papers.

In the paper path switch device constructed as shown in FIG. 15, since the papers can move in two directions only, a problem arises in that the paper path switch device is required in every position where the papers are dispensed.

Since the papers cannot move to various positions using one paper path switch device, paper path switch devices are required in proportion to the number of increasing modules.

SUMMARY OF THE INVENTION

The present invention is directed to a finishing apparatus of an image forming apparatus and a method for controlling the same that substantially obviates one or more of the problems due to limitations and disadvantages of the related art.

A finishing apparatus of the present invention includes a paper conveyer module 40 detachably fixed to an image tray module 15, a mail box module 10, a finisher module 20, and a booklet module 16, the paper conveyer module being detachably fixed in a copier 1.

The paper conveyer module 40 includes a controller sensing whether the respective modules are detachably provided to selectively control functions of the respective modules in accordance with an output signal of the copier.

A user can selectively use the respective modules. Thus, when papers are caught between the paper conveyer module and the respective module or between the copier and the paper conveyer module in the process of moving the papers, it is possible to easily remove the caught papers.

In addition, paper path switch devices provided in the paper conveyer module include a plurality of paper dispensers each having an elliptical curved part on a pair of plate shaped shafts. The plate shaped shafts are spaced apart from each other and arranged to oppose each other. The elliptical curved part is arranged toward an outer side of the shafts.

The shafts provided with the paper dispensers are rotated at 360° by a worm gear, and the rotational angle and position of the shafts are controlled by a groove sensor that senses the rotational position of the worm gear and a position sensor that senses the position of the groove sensor.

The paper dispensers rotate the shafts to move the papers in a straight direction through a space between the shafts while they change the rotational angle of the shafts to change a moving direction of the papers along the curved parts when the papers move by changing a paper moving path at a predetermined angle.

In other words, when the papers move in a straight direction, they move through the space formed between the shafts. When the papers move at a predetermined angle, they move using the curved parts of the paper dispensers.

Accordingly, an object of the present invention is to provide a finishing apparatus of an image forming apparatus and a method for controlling the same, in which various block modules performing finishing functions are provided and a user can selectively use any module by detachably fixing the same in a copier.

Another object of the present invention is to provide a finishing apparatus of an image forming apparatus and a method for controlling the same, in which papers caught in the image forming apparatus can easily be removed.

Another object of the present invention is to provide a finishing apparatus of an image forming apparatus and a method for controlling the same, in which respective modules can easily be detached from a copier and the finishing apparatus can easily be detached from the copier by providing a paper conveyer module that controls functions of the respective modules.

Another object of the present invention is to provide a finishing apparatus of an image forming apparatus and a method for controlling the same, in which a paper path switch device is provided in a paper conveyer module to move papers in various directions.

Additional features and advantages of the invention will be set forth in the description which follows, and in part will be apparent from the description, or may be learned by practice of the invention. The objectives and other advantages of the invention will be realized and attained by the scheme particularly pointed out in the written description and claims hereof as well as the appended drawings.

To achieve these and other advantages and in accordance with the purpose of the present invention, as embodied and broadly described, a finishing apparatus which finishes papers ejected from an image forming apparatus includes a plurality of paper processing modules, a controller sensing whether the respective paper processing modules are detachably fixed to the image forming apparatus to transmit and receive functional signals of the respective modules to and from the image forming apparatus, and a paper conveyer module detachably fixed in the image forming apparatus.

The paper processing modules are comprised of one or more modules selected from an image tray module constructed to stack the papers ejected from the image forming apparatus through the paper conveyer module, a mail box module selectively dispensing the papers ejected from the image forming apparatus into a plurality of bins, a finisher module stapling or punching the papers ejected from the image forming apparatus to stack them on a stack tray, and a booklet module binding the papers ejected from the image forming apparatus to stack them on an eject tray.

The paper conveyer module is constructed to detach the selected paper processing modules.

The paper conveyer module includes a paper path switch device (paper dispensing means) guiding the papers to the paper processing modules, and the paper patch switch device is turned on/off by a controller of the paper conveyer module.

The paper path switch device includes a rotational means of which rotational position is controlled by a position sensing means, a pair of shafts connected with the rotational means and spaced apart in parallel from each other to rotate at a predetermined angle along a central shaft, and paper dispensers provided on the circumference of the shafts, each having an elliptical curved part arranged outwardly and the shafts provided with the paper dispensers being arranged in a position where a plurality of paper moving paths are divided.

The rotational means includes a shaft gear fixed to the central shaft of the shafts and a motor rotating a worm gear engaged with the shaft gear.

The position sensing means includes a groove sensor fixed to the worm gear and a position sensor sensing the position of the groove sensor to control rotation of the motor so that the worm gear rotates at a predetermined angle.

The shafts rotating along the central shaft are arranged in such a way that plate shaped planes arranged in parallel oppose each other, and the paper dispensers are arranged along the shafts having the plate shaped planes.

The shafts have a "T" shape by forming a protrusion on the circumference of the plate shaped planes in a single body, and the paper dispensers are respectively fitted into the "T" shaped shafts.

Meanwhile, each bin of the main box module includes a bin flap guiding the papers moved through the paper conveyer module, and the bin flap is turned on/off by the controller of the paper conveyer module.

In another aspect of the present invention, in a method for controlling a finishing apparatus including a plurality of paper processing modules stacking papers ejected from an image forming apparatus, at least one paper path switch device operating to dispense the papers ejected from the image forming apparatus to the selected paper processing module, and a paper conveyer module which includes a controller controlling the operation of the paper processing module by sensing whether the paper processing module is detached from the paper conveyer module, the method includes the steps of determining in the controller whether the paper processing module is fixed to the paper conveyer module, transmitting a function performing signal of the paper processing module to the controller of the image forming apparatus if the paper processing module is fixed to the paper conveyer module, thereby synchronizing the signal, and turning on/off the paper path switch device in the controller to move the papers to the paper processing module if the function performing signal of the paper processing module selected from the controller of the image forming apparatus is applied to the controller of the paper conveyer module.

It is to be understood that both the foregoing general description and the following detailed description are exemplary and explanatory and are intended to provide further explanation of the invention as claimed.

BRIEF DESCRIPTION OF THE ATTACHED DRAWINGS

The invention will be described in detail with reference to the following drawings in which like reference numerals refer to like elements wherein.

Figure 4:
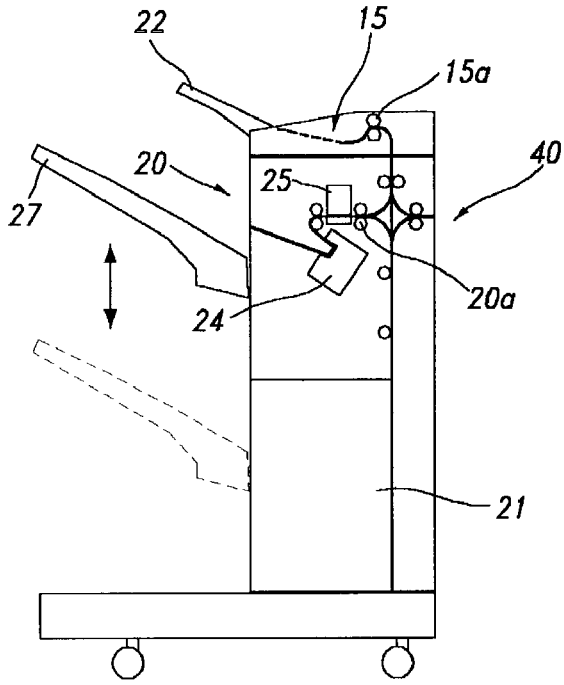
Figure 5A:
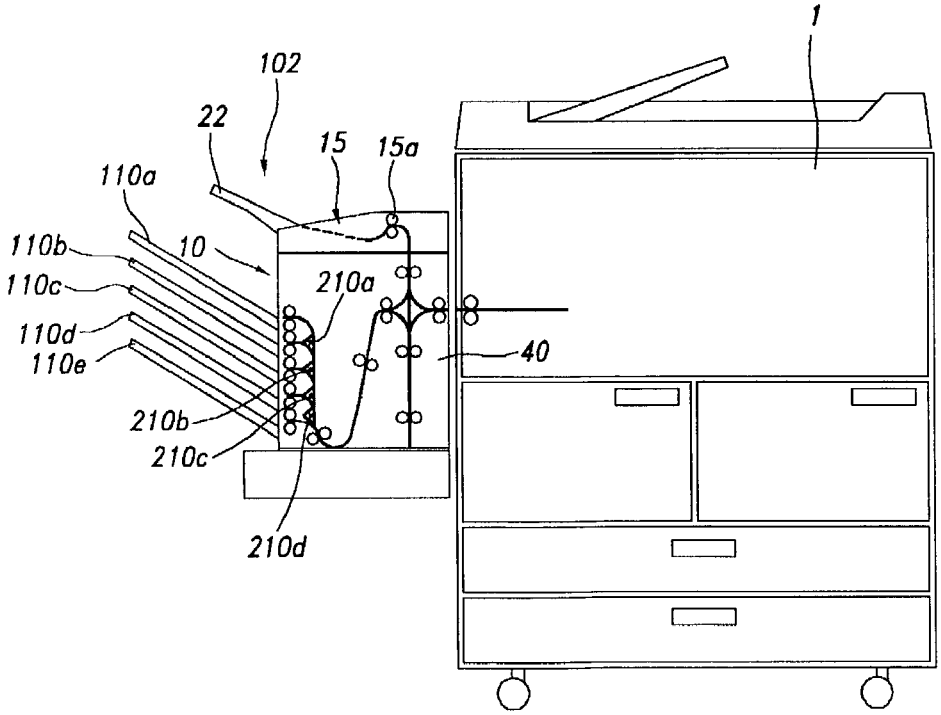
Figure 5B:
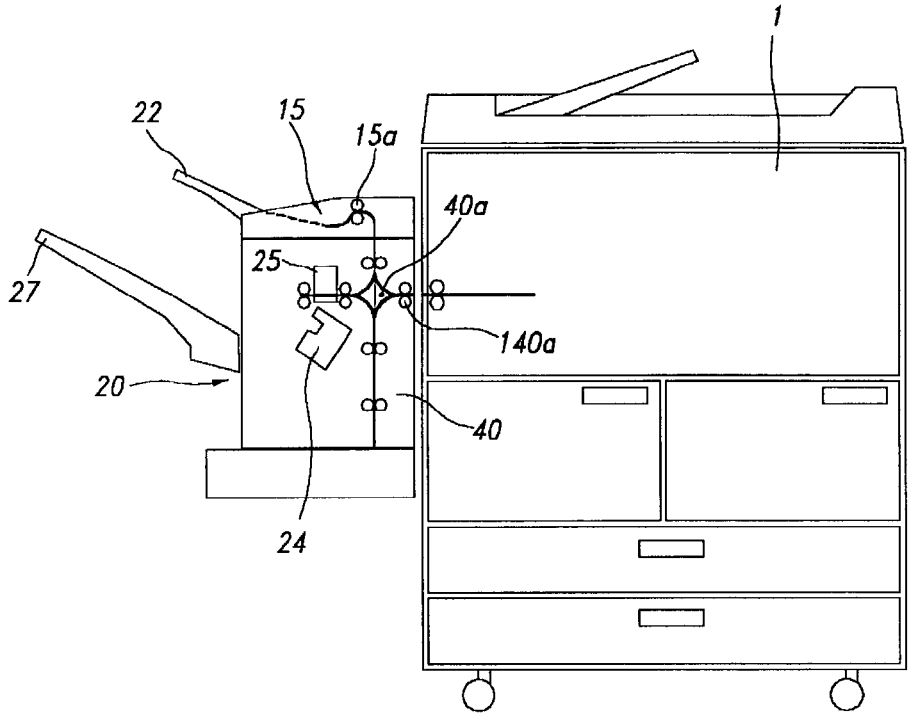
Figure 5C:
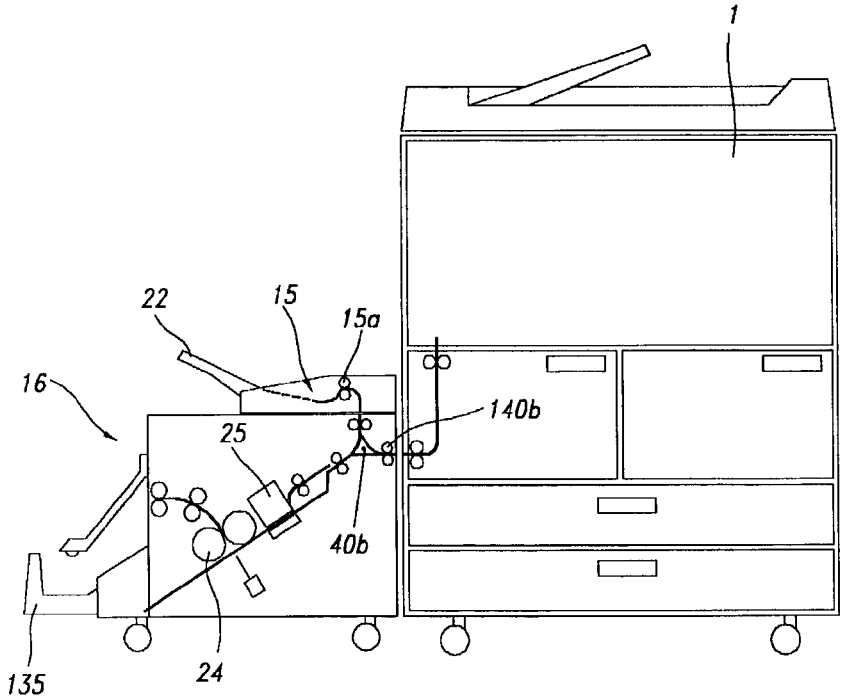
Figure 6A:
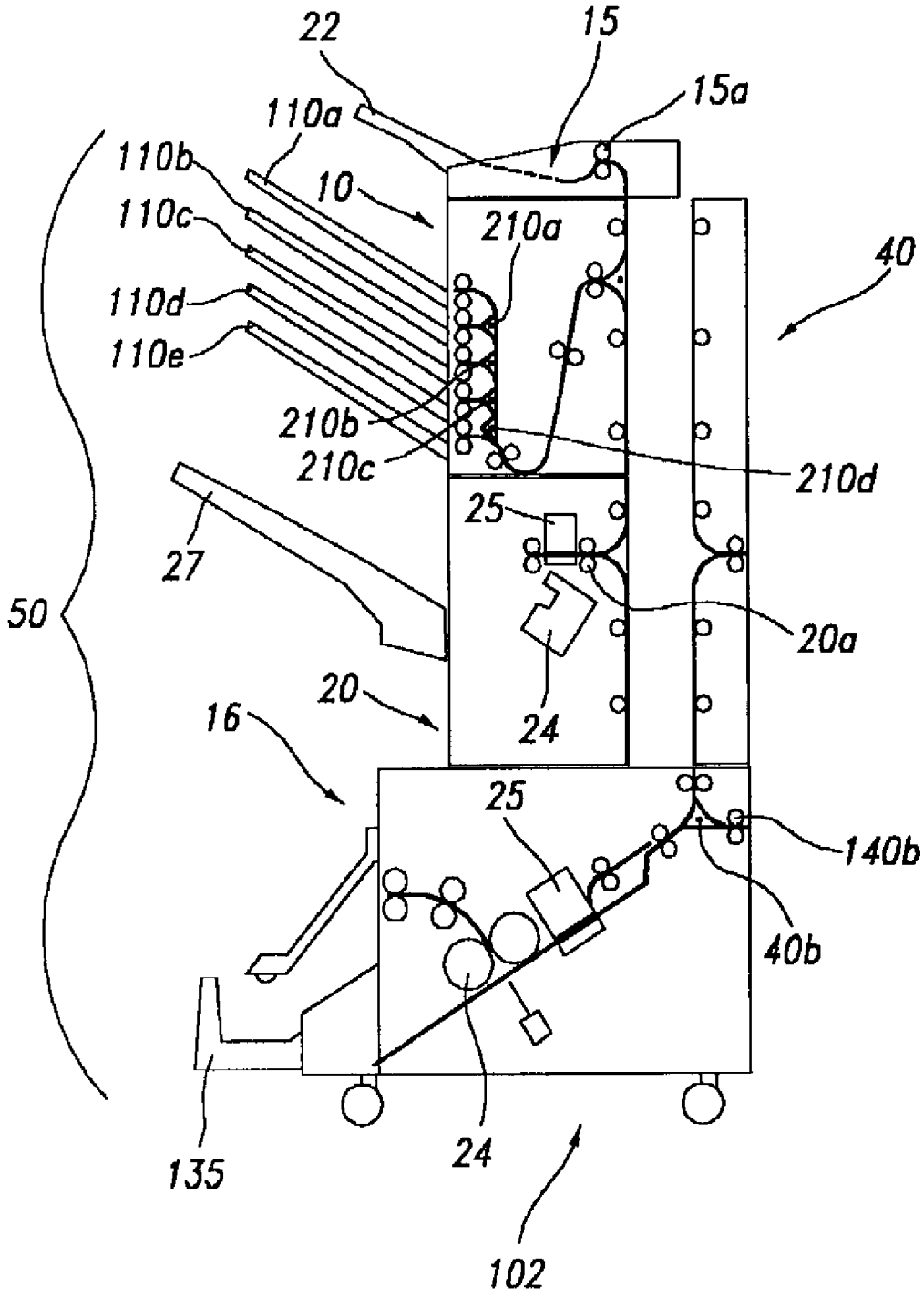
Figure 6B:
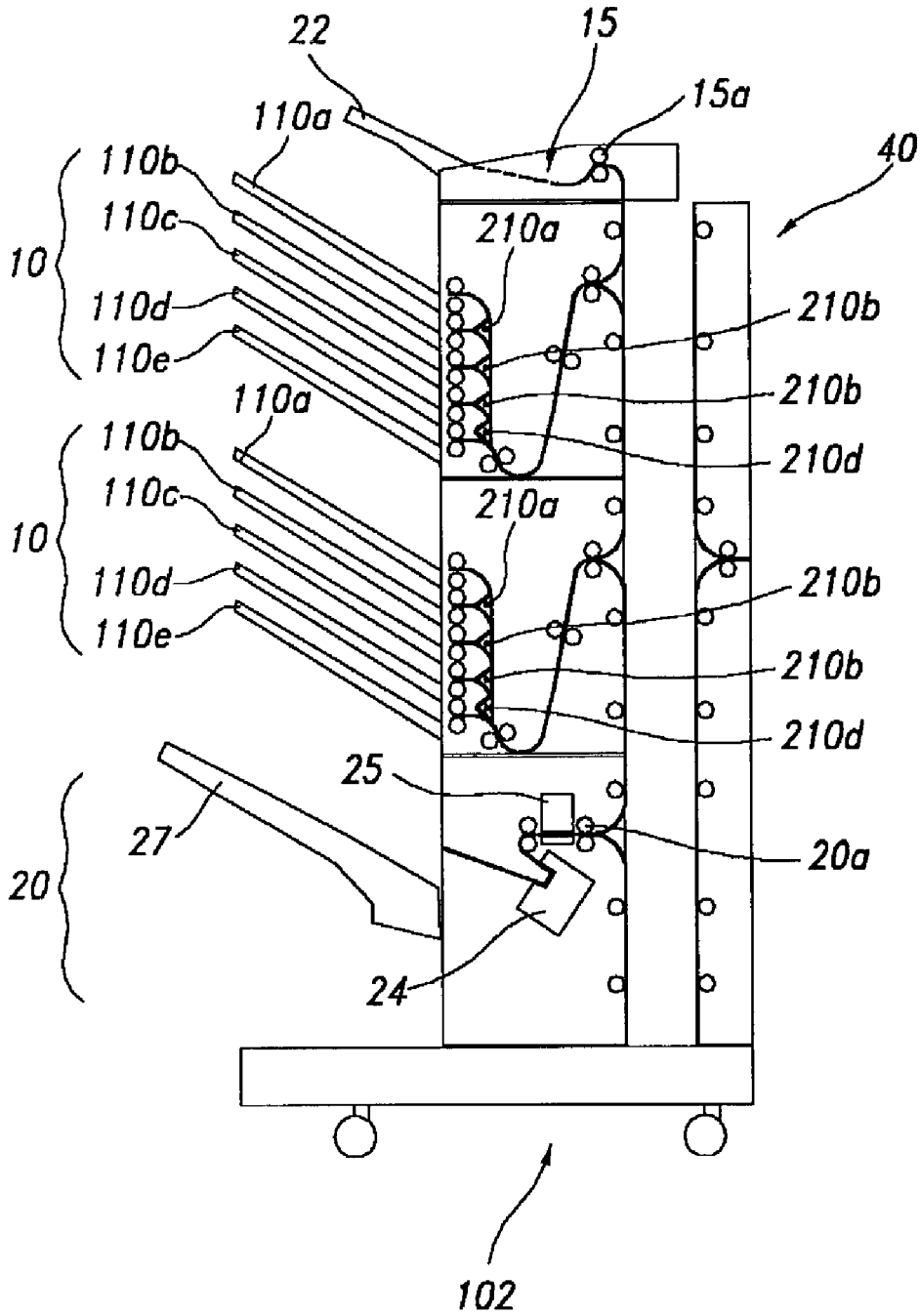
Figure 7:
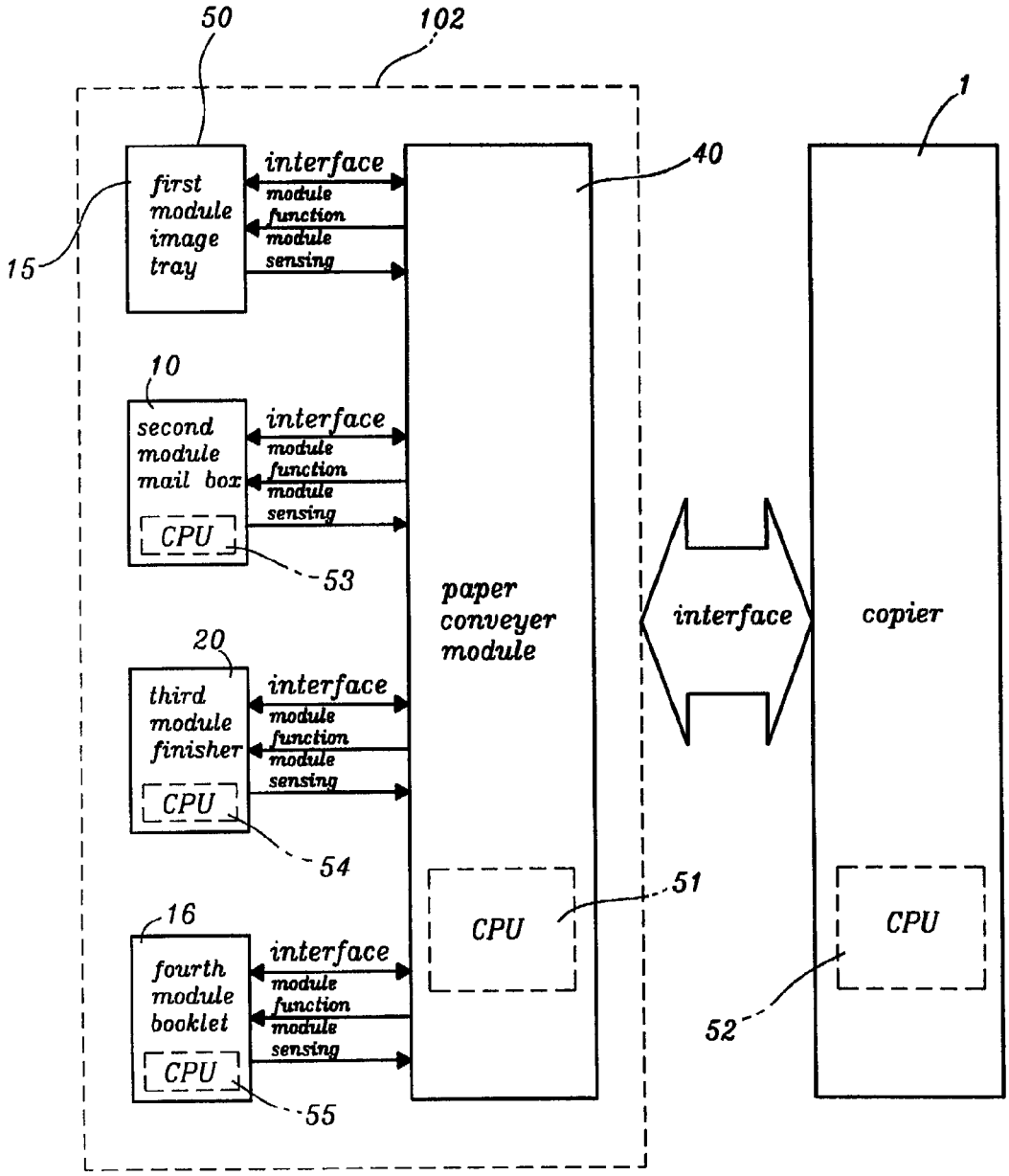
Figure 8:
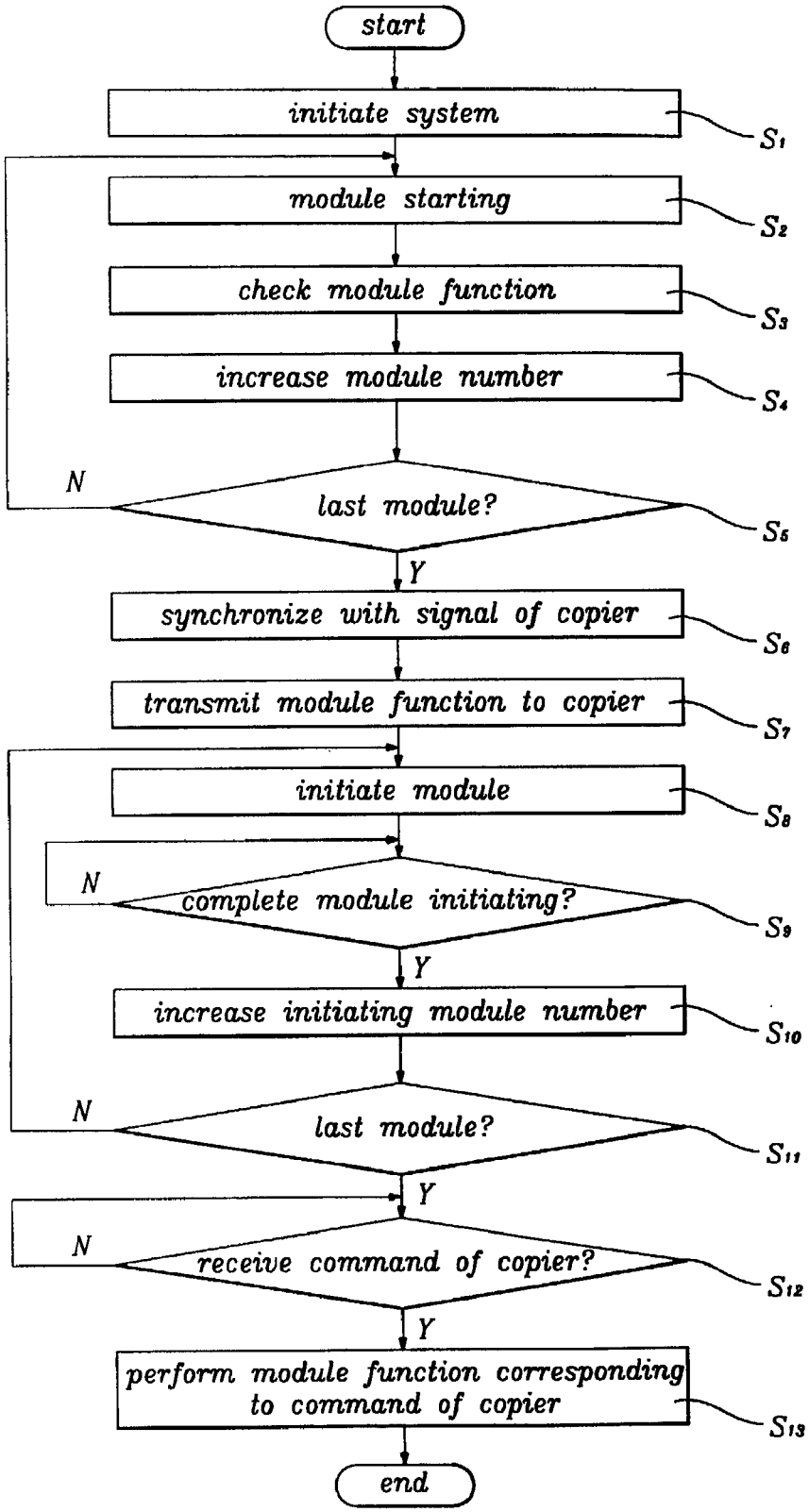
Figure 9:
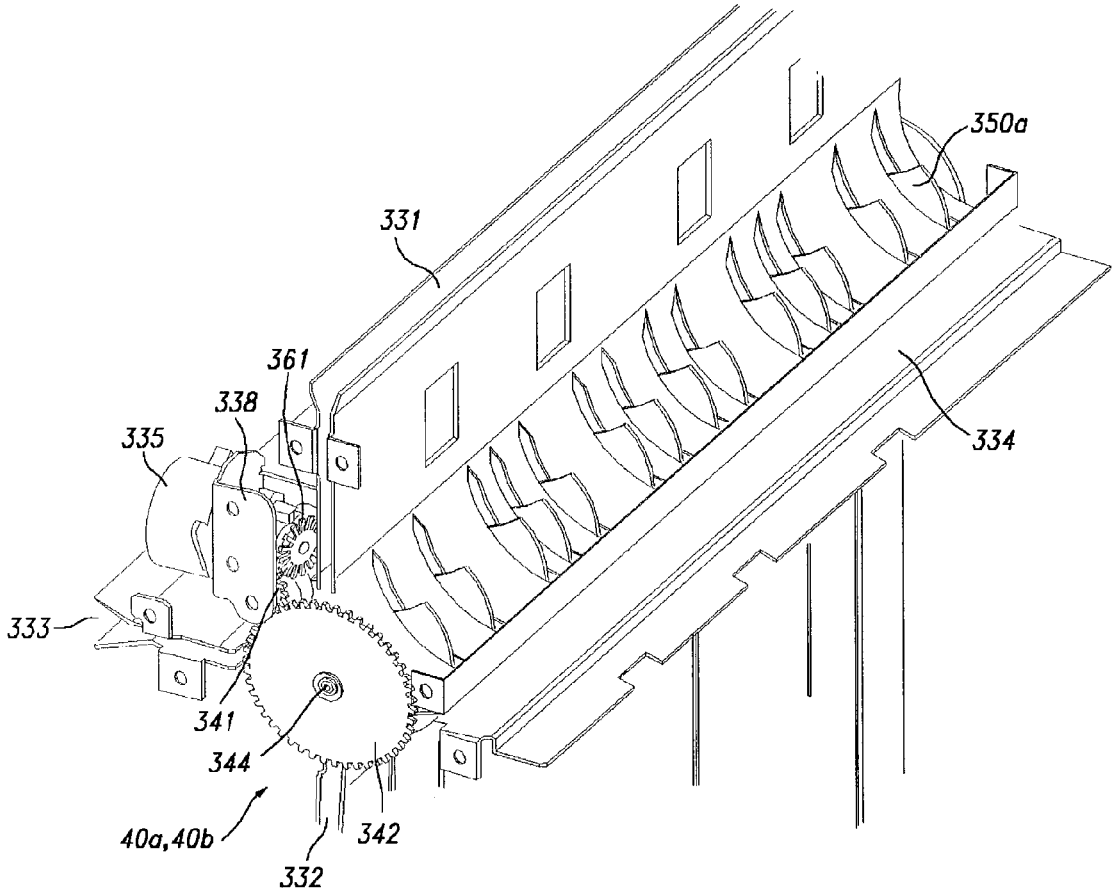
Figure 10:
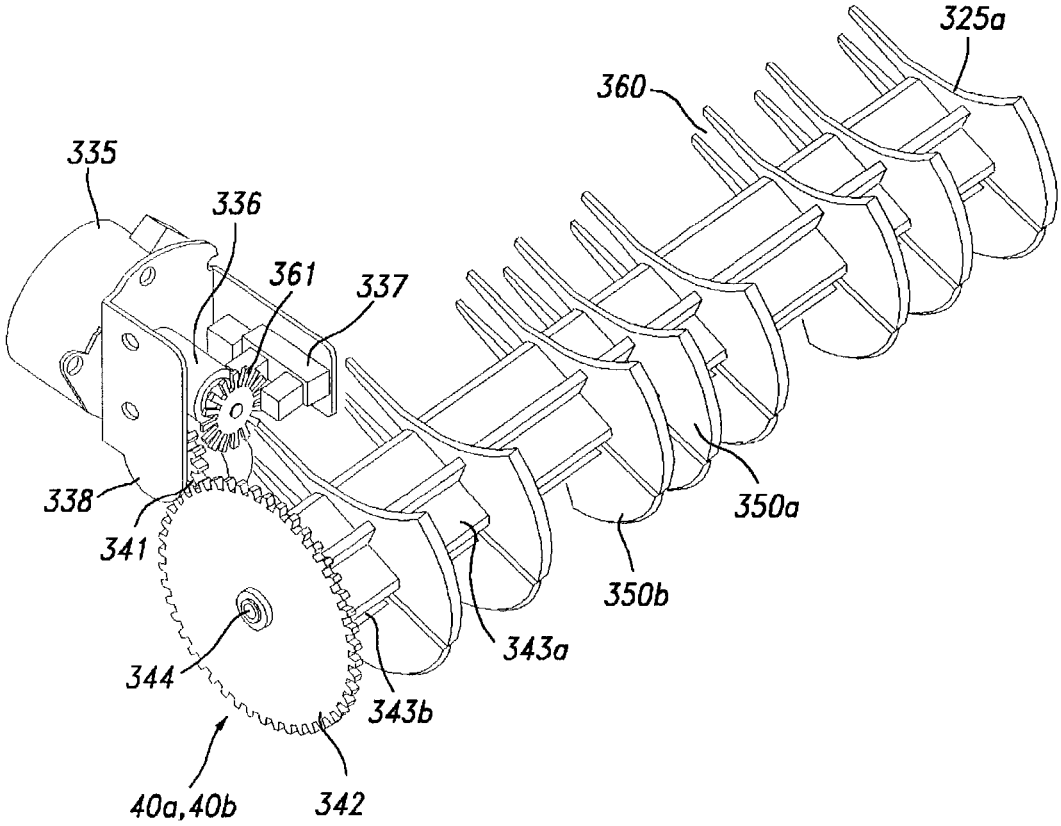
Figure 11:
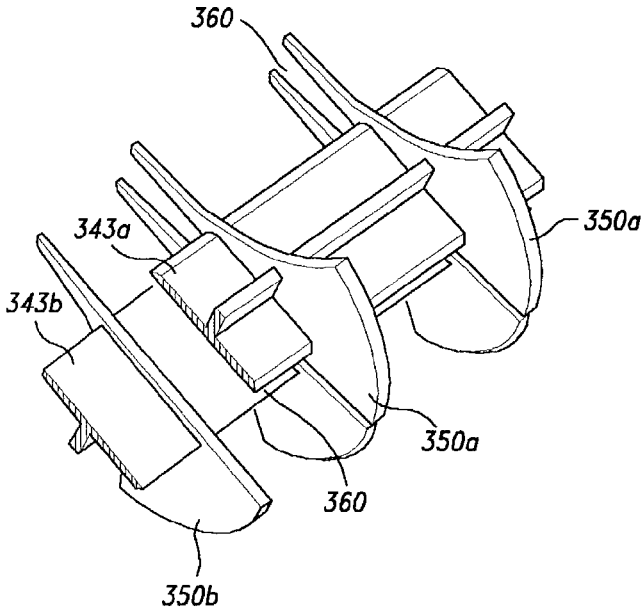
Figure 12A:
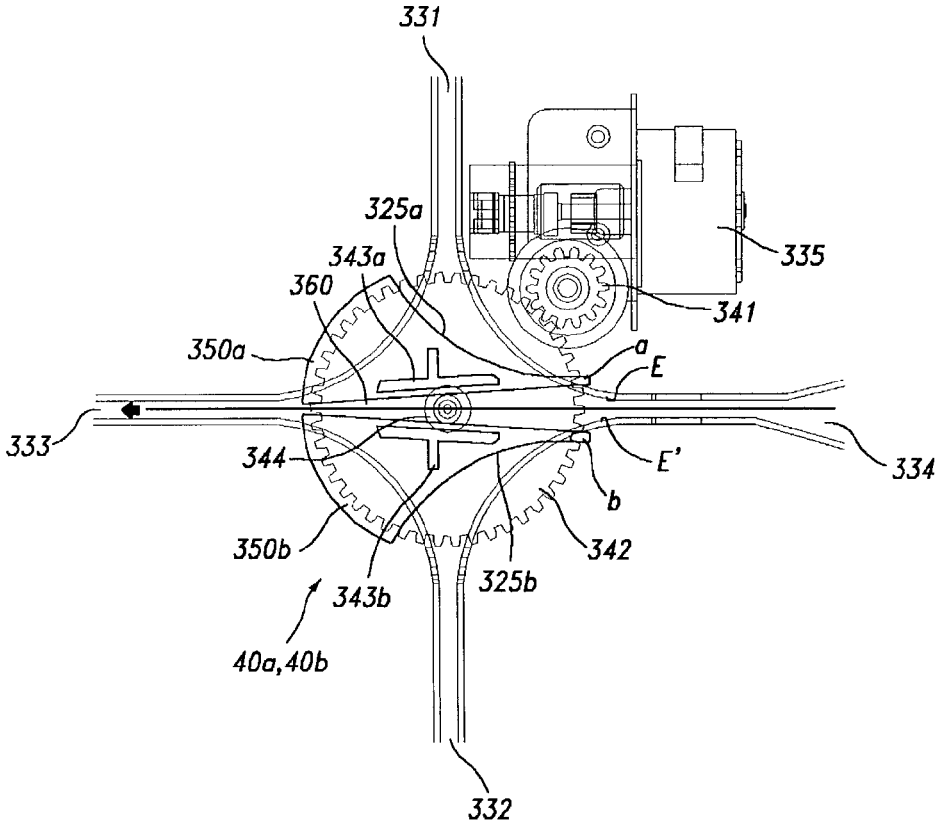
Figure 12B:
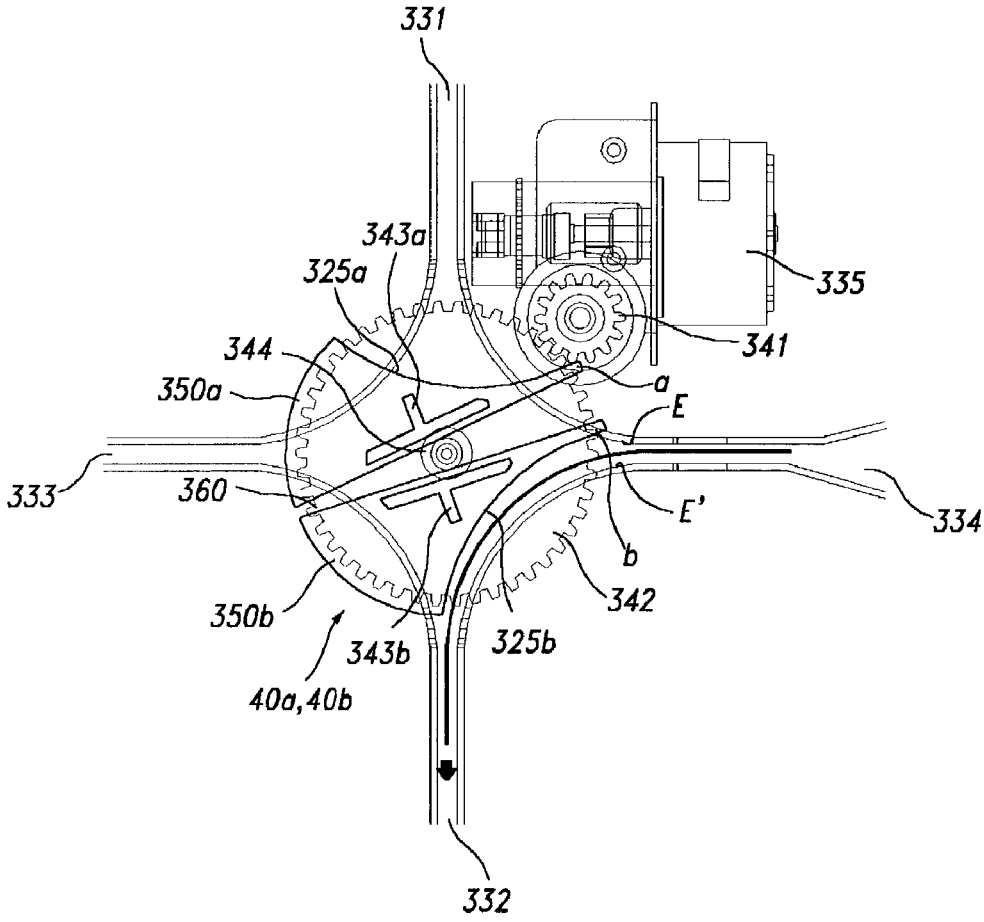
Figure 12C:
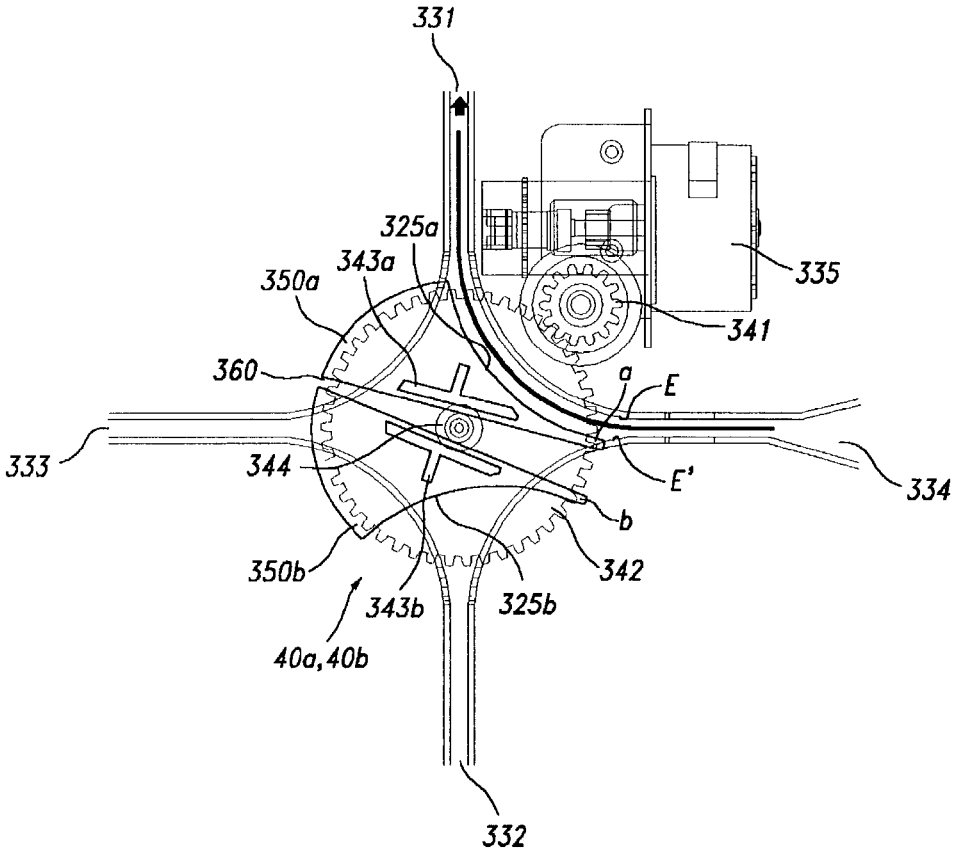
Figure 13:
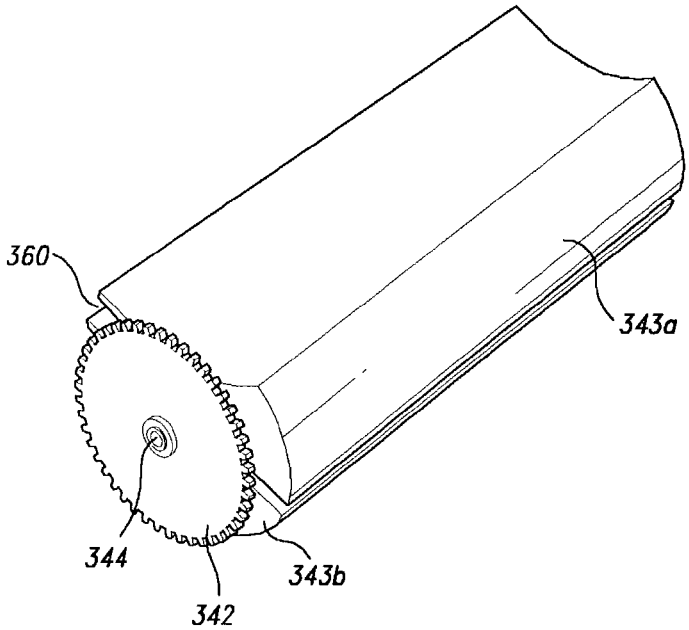
Figure 14A:
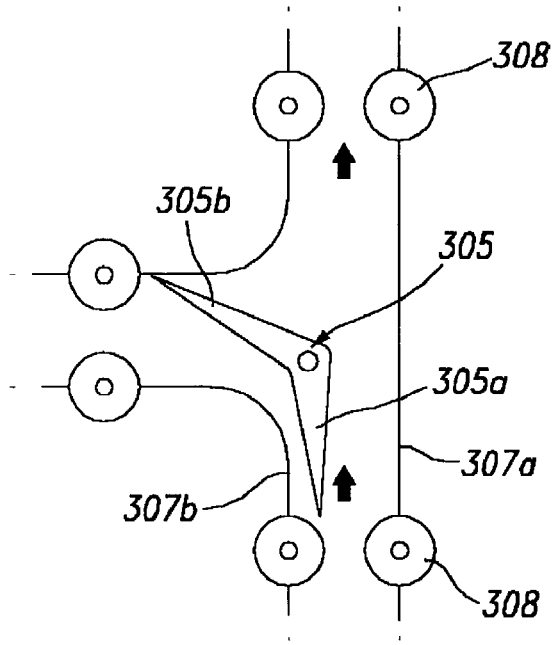
FIG 14a PRIOR ART
Figure 14B:
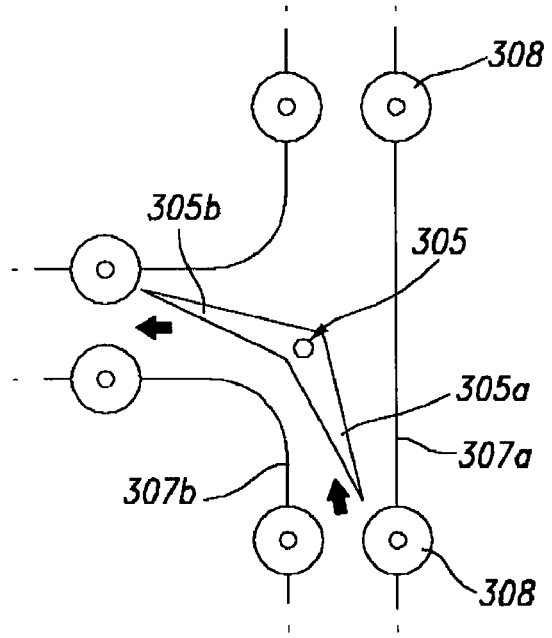
FIG 14b PRIOR ART
Figure 15:
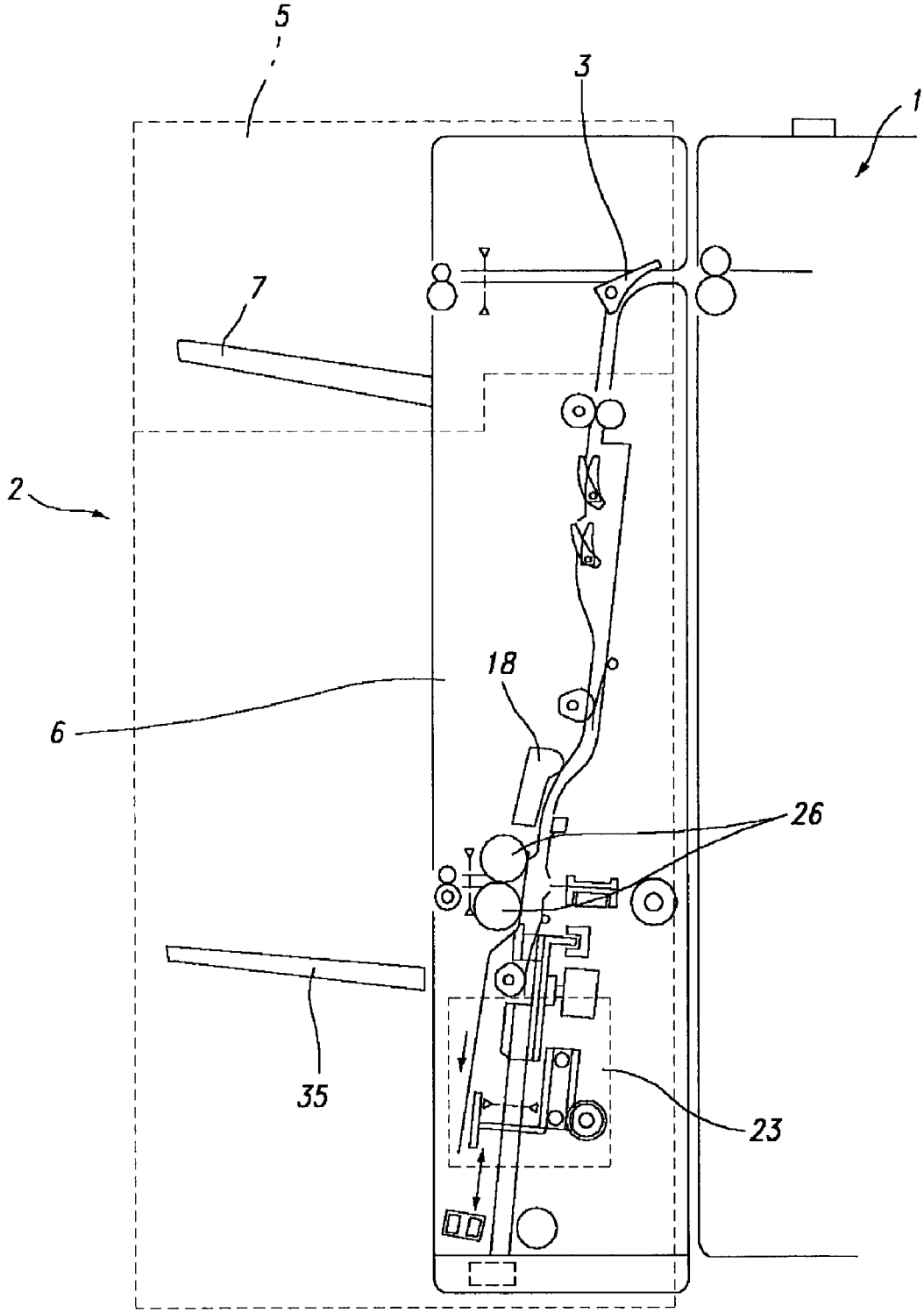
FIG 15 PRIOR ART

FIGS. 3*a* to 3*f* illustrate fixed states of respective modules of a finishing apparatus according to the present invention;

FIG. 4 illustrates another finishing apparatus according to the present invention;

FIGS. 5*a* to 5*c* illustrate another states where a finishing apparatus of the present invention is fixed to a copier;

FIGS. 6*a* and 6*b* illustrate states where a conveyer of a finishing apparatus is detached in accordance with the present invention;

FIG. 7 is a block diagram illustrating the operation of controlling a finishing apparatus according to the present invention;

FIG. 8 is a flow chart illustrating the operation of controlling a finishing apparatus according to the present invention;

FIGS. 9 and 10 are perspective views illustrating a paper dispensing means provided in a paper conveyer module according to the present invention;

FIG. 11 is a perspective view illustrating a structure of a pair of shafts to which a paper dispenser is fixed in a paper dispensing means according to the present invention;

FIGS. 12*a* to 12*c* illustrate the operation of dispensing a moving path of papers into various paths in accordance with a rotational position of shafts to which a paper dispenser is fixed in a paper dispensing means according to the present invention;

FIG. 13 illustrates another structure of a pair of shafts in a paper dispensing means according to the present invention;

FIGS. 14*a* and 14*b* illustrate structures of a related art paper dispensing means according to the present invention; and FIG. 15 illustrates a related art finishing apparatus.

DETAILED DESCRIPTION OF THE PREFERRED EMBODIMENTS

Reference will now be made in detail to the preferred embodiments of the present invention, examples of which are illustrated in the accompanying drawings.

A finishing apparatus of an image forming apparatus according to the present invention will be described with reference to FIGS. 1 to 13.

The finishing apparatus according to the present invention includes a paper conveyer module 40 detachably provided in an image forming apparatus such as a copier 1, and a paper processing module 50 detachably provided in the paper conveyer module 40. The paper processing module 50 includes an image tray module 15, a mail box module 10, a finisher module 20, and a booklet module 16.

Paper path switch devices 10*a*, 40*a*, and 40*b* are provided between the paper conveyer module 40 and the paper processing module 50. The paper path switch devices 10*a*, 40*a*, and 40*b* act as paper dispensing means for dispensing papers ejected from the copier 1. A microprocessor (i.e., controller) 51 for controlling a driving signal of the finisher module is also provided.

The paper path switch devices 10*a*, 40*a*, and 40*b* are controlled by the controller 51 so that papers can selectively move to the image tray module 15, the mail box module 10, the finisher module 20, and the booklet module 16.

The papers moving through the paper path switch device 40*b* are controlled by the controller 51 so as to move to the booklet module 16.

In the booklet module of the present invention, the papers moved from the image forming apparatus move through any one of the paper path switch devices 40*a* and 40*b*.

Meanwhile, moving rollers 20*a* and 15*a* are provided at inlets of the finisher module 20 and the image tray module 15 so that the papers ejected from the paper path switch device 40*a* are guided to the finisher module or the image tray module.

The mail box module 10 includes a plurality of bins 110*a*, 100*b*, 110*c*, 110*d*, and 110*e* and bin flaps 210*a*, 210*b*, 210*c*, and 210*d*. The bins 110*a* to 110*e* dispense papers passed through the paper path switch devices 40*a* and 40*a* and stack the papers. The bin flaps 210*a* to 210*d* are provided at an inlet of each bin. The bin flaps are turned on/off by the controller 51 of the paper conveyer module 40.

Figure 1:
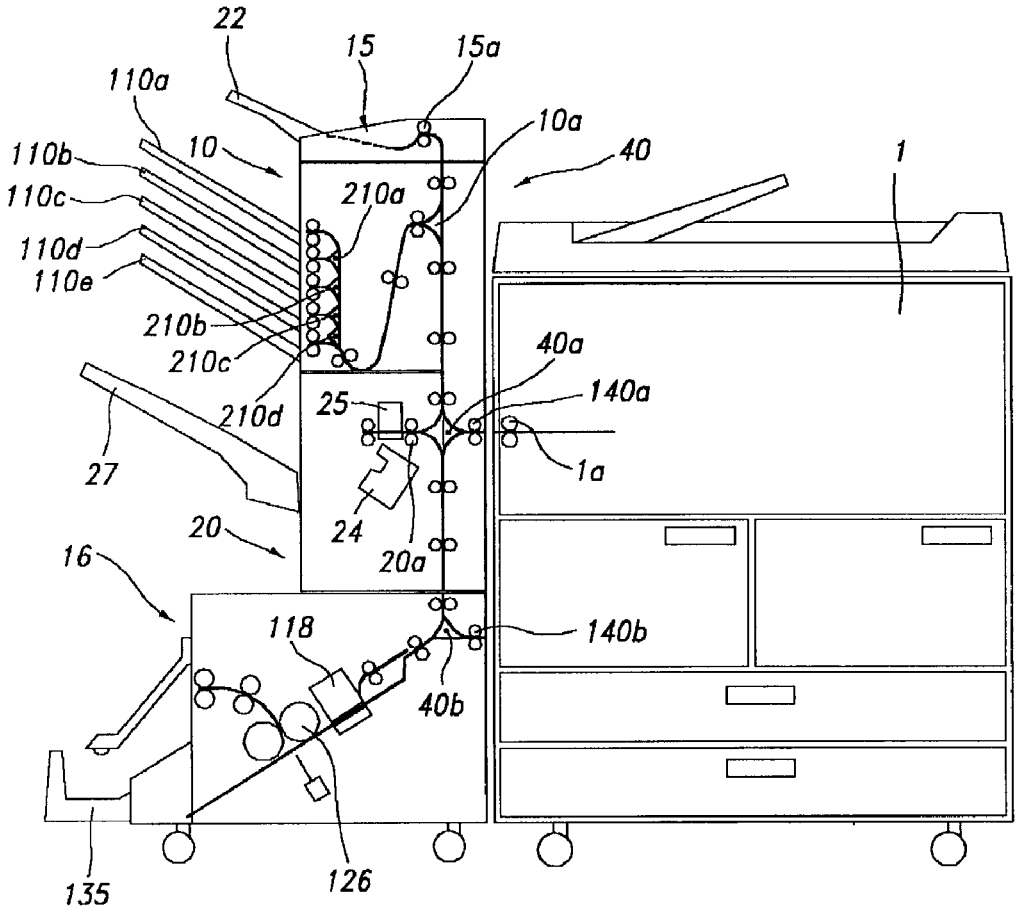
FIG. 1 illustrates a state where a finishing apparatus of the present invention is fixed to a copier.
Figure 2:
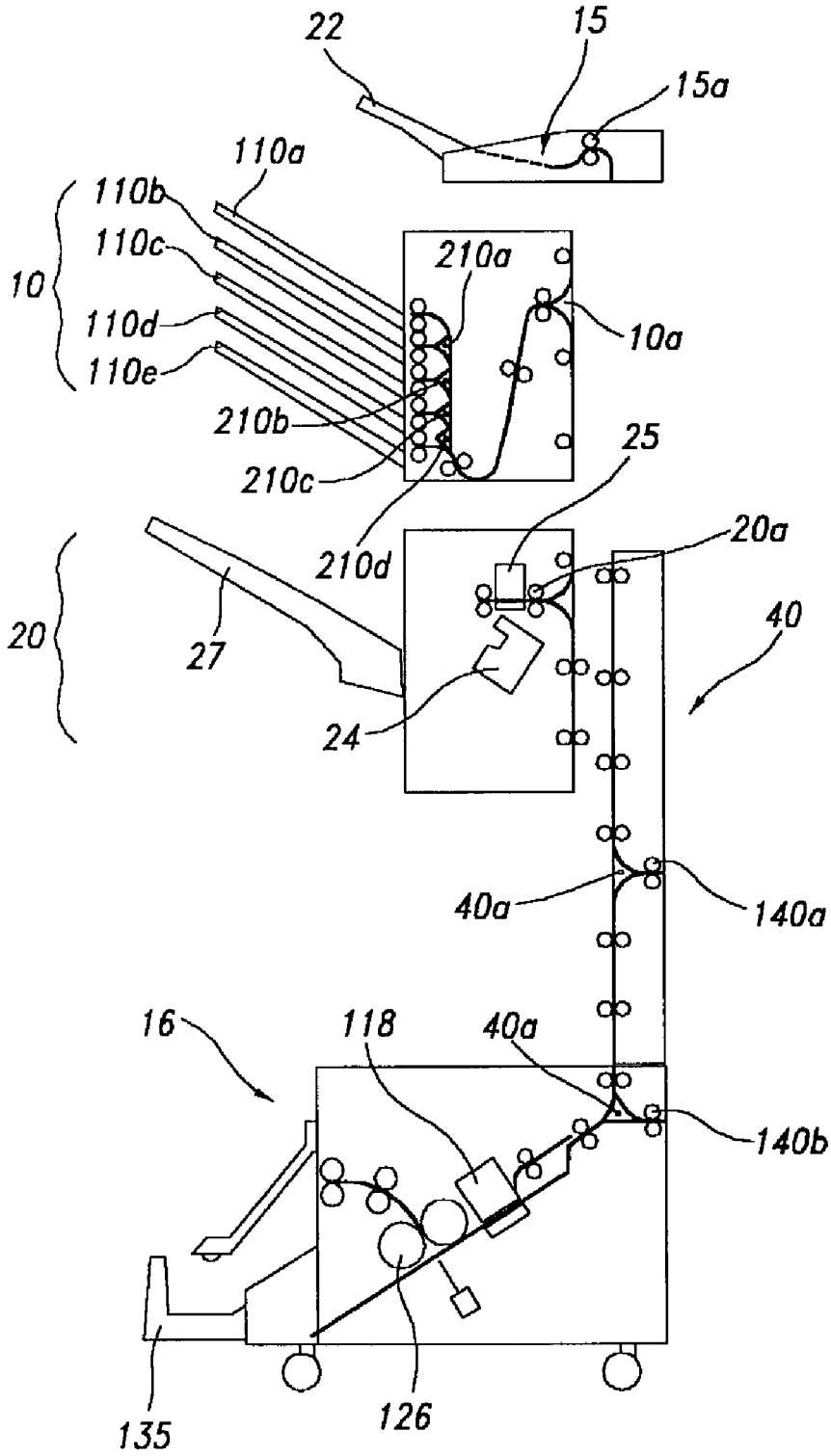
FIG. 2 illustrates respective modules of a finishing apparatus, which are detached from one another in accordance with the present invention.
Figure 3A:
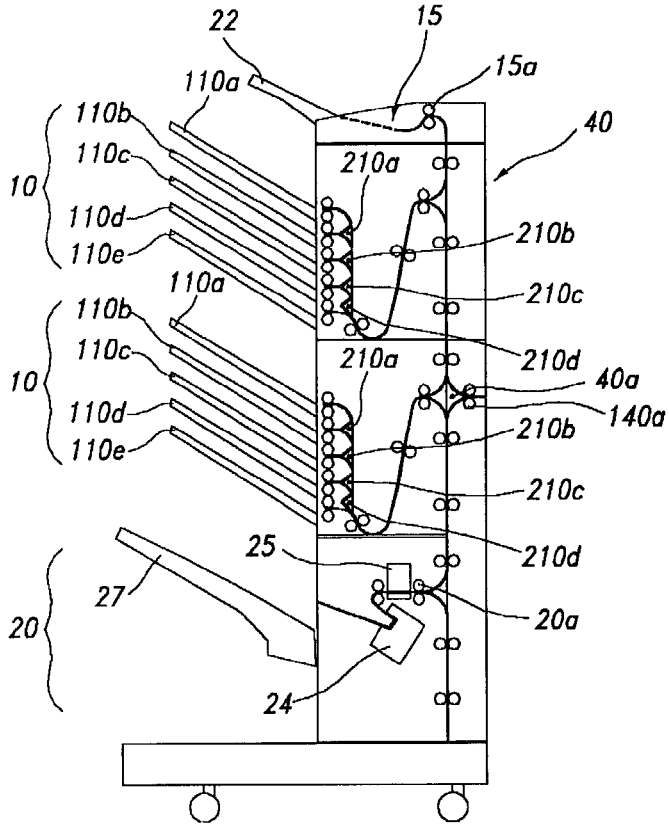
Figure 3B:
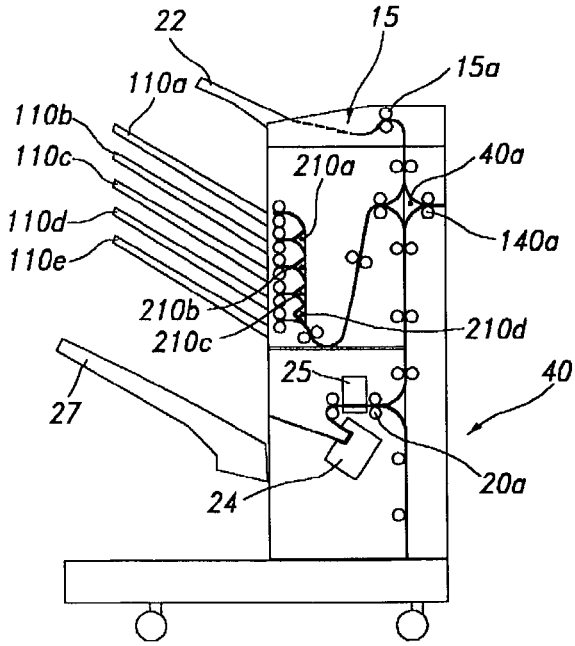
Figure 3C:
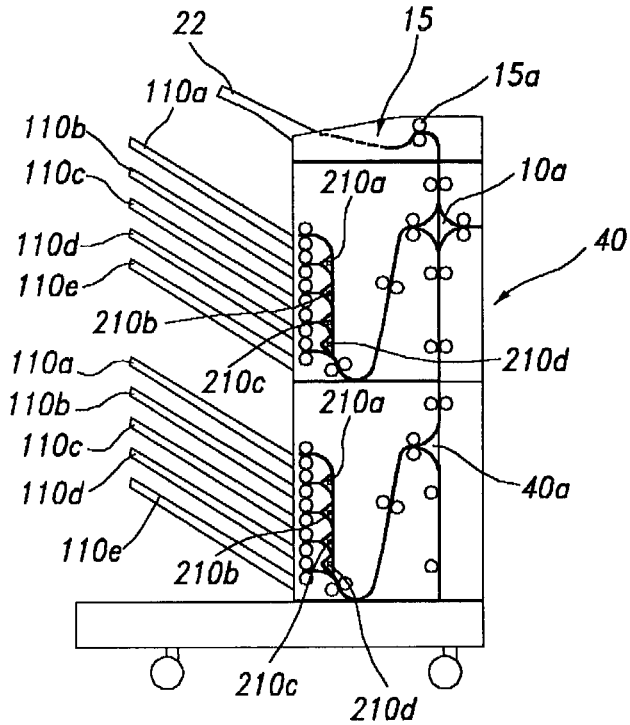
Figure 3D:
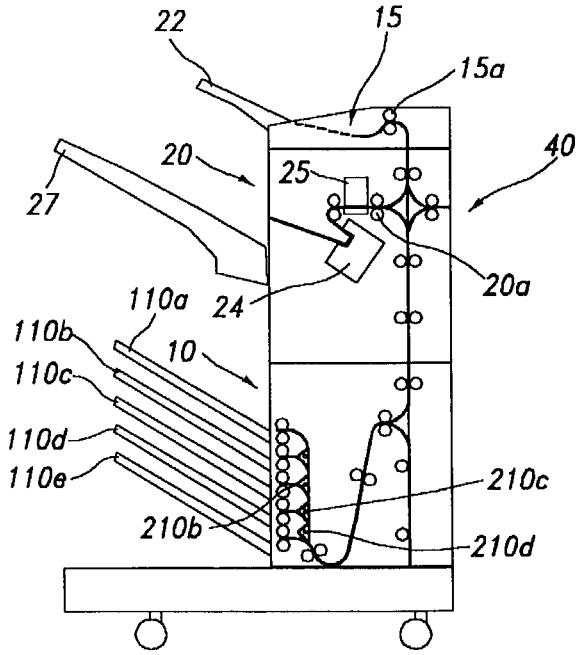
Figure 3E:
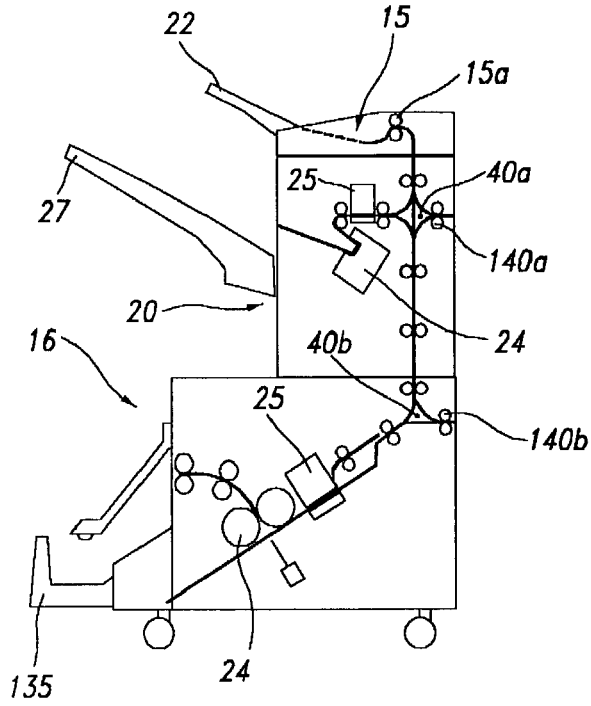
Figure 3F:
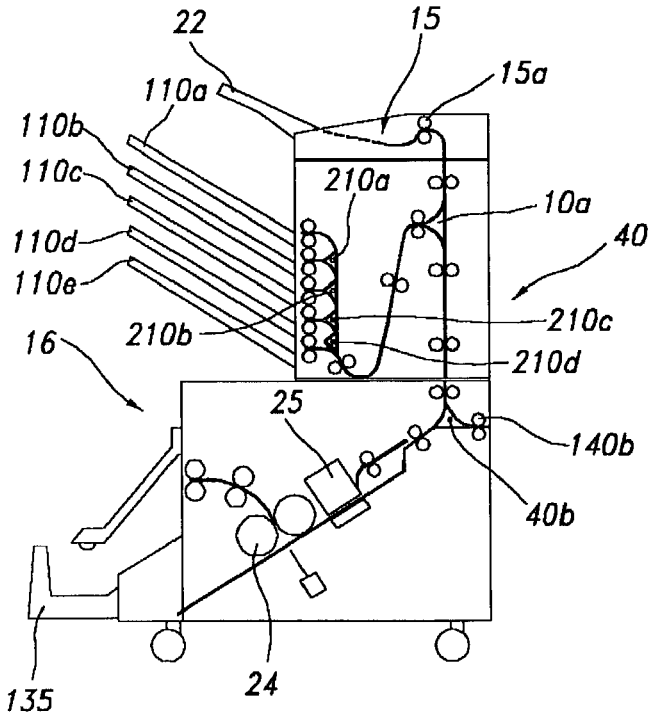

The paper processing module 50, as shown in FIG. 2, is detachably provided in the paper conveyer module 40. The image tray module, the mail box module, the finisher module, and the booklet module in the paper processing module are selectively provided in the paper conveyer module 40.

The image tray module 15 allows the papers moved through the paper conveyer module 40 to be stacked on the image tray 22 in the order of movement of the papers.

The mail box module 10 allows the papers moved through the paper conveyer module 40 to be dispensed into the bins 110*a* to 110*d* in accordance with the user's setting.

The finisher module 20 punches the papers moved through the paper conveyer module 40 using a punch 25 or staples them using a stapler 24. Then, the finisher module 20 stacks the papers on a stacker tray 27.

The booklet module 16 binds the papers moved through a stapler unit 118 and a folding roller 126 and then stacks them on an eject tray 135. The booklet module 16 can be based on the structure disclosed in the Korean Patent Application No. 2001-84197 filed by the applicant of this invention.

The aforementioned paper processing module 50 can easily be constructed by combination of modules illustrated in FIGS. 3*a* to 3*f* in accordance with the user's selection. The paper conveyer module 40 is detachably fixed to the copier 10 by positioning a moving roller 140*a* and a moving roller 1*a* of the copier 1 on the same line.

In the aforementioned finishing apparatus, the paper processing module constructed in various structures as shown in FIGS. 3*a* to 3*f* can detachably be fixed to the paper conveyer module 40. The paper conveyer module 40, as shown in FIGS. 1 and 5*a* to 5*c*, is detachably fixed to the copier 1.

Particularly, the finisher module 20 can be provided with a finisher expanding module 21 so as to increase the capacity of the stack tray 27 as shown in FIG. 4. The stack tray 27 is constructed in such a way that it can move between the finisher module and the finisher expanding module.

If the papers are caught between the paper processing module 50 and the paper conveyer module 40, as shown in FIGS. 6*a* and 6*b*, the modules are provided in block types so that they can simply be detached from each other, thereby facilitating sliding, fixation, and detachment.

The paper path switch devices 40*a* and 40*b* provided in the paper conveyer module 40 are constructed so as to move the papers in all directions.

The structure and operation of the paper path switch devices 40*a* and 40*b* according to the present invention will be described in more detail with reference to FIGS. 9 to 13.

As shown in FIGS. 9 to 13, the paper path switch devices 40*a* and 40*b* are provided in a crossing portion where a left paper moving path 333, a right paper moving path 334, an upper paper moving path 331, and a lower paper moving path 332 cross.

The paper path switch devices 40*a* and 40*b* are provided so that a pair of "T" shaped shafts 343*a* and 343*b* are spaced apart from each other and oppose each other based on a central shaft 344 of a shaft gear 342. The shafts 343*a* and 343*b* are arranged to oppose their planes each other. A plurality of paper dispensers 350*a* and 350*b* are provided in the shafts 343*a* and 343*b*.

The central shaft 344 acts as a rotational center of the shaft gear 342 so that the shafts 343*a* and 343*b* are rotatably arranged to oppose each other based on the shaft 344.

The paper dispenser 350*a* is arranged along the shaft 343*a* while the paper dispenser 350*b* is arranged along the shaft 343*b*. The paper dispensers 350*a* and 350*b* have elliptical curved parts 325*a* and 325*b*, respectively. The elliptical curved parts 325*a* and 325*b* are respectively provided toward an outer direction of their respective shaft.

A space 360 is formed between the curved parts 325*a* and 325*b* and between the shafts 343*a* and 343*b*. The space 360 serves to guide and move the papers in a straight direction in accordance with the rotational position of the shafts.

As one example, supposing that the papers are moving through the right paper moving path 334 in FIG. 9, the papers directly move to the left paper moving path 333 through the space 360, i.e., between the paper dispensers 350*a* and 350*b*.

Also, the papers move from the right paper moving path 334 to the upper paper moving path 331 under the guide of the curved part 325*a* of the paper dispenser 350*a* by rotating the shaft 344 at a predetermined angle.

The operation of the paper path switch devices according to the present invention will be described in more detail with reference to FIGS. 12*a* to 12*c*.

The paper path switch devices 40*a* and 40*b* are provided in the crossing portion where the left paper moving path 333, the right paper moving path 334, the upper paper moving path 331, and the lower paper moving path 332 cross. The ends of the pair of shafts 343*a* and 343*b* are fixed to the central shaft 344 or the shaft gear 342 to rotate around the central shaft 344 of the shaft gear 342. The shaft gear 342 is rotated in a state where it is engaged with a worm gear 341 driven by a motor 335. The rotational angle of the central shaft 344 is controlled by a groove sensor 336 and a position sensor 337. The groove sensor 336 senses the rotational position of the worm gear 341 while the position sensor 337 senses the position of the groove sensor 336.

The position sensor 337 can control a rotation control signal of the motor by sensing the rotational position of a slot plate 361 separately provided on the shaft gear or the worm gear.

Meanwhile, the opposing shafts 343*a* and 343*b* have "T" shape, so that they are firmly supported when they are fitted into the paper dispensers 350*a* and 350*b*.

The elliptical curved part 325*a* is formed in the paper dispensers 350*a* while the elliptical curved part 325*b* is formed in the paper dispenser 350*b*. The power dispensers 350*a* and 350*b* are fixed to the shafts so that they are symmetrical to each other. The space 360 is formed between the shafts.

As one example, supposing that the papers are moving through the right paper moving path 334, the central shaft 344 should be rotated to match an end "a" of the paper dispenser 350*a* with an upper end "E" and an end "b" of the paper dispenser 350*b* with a lower end "E'" as shown in FIG. 12*a*, thereby moving the papers to the left paper moving path 333.

In other words, the papers move in a straight direction by rotating the paper path switch device to place the space 360 and the paper moving paths 333 and 332 on the same line.

Also, if the papers move from the right paper moving path 334 to the lower paper moving path 332, the central shaft 344 connected with the shafts 343*a* and 343*b* is rotated counterclockwise at a predetermined angle by power transmission of the shaft gear 342 so that the end "b" of the power dispenser 350*b* is positioned in the upper end "E" of the right paper moving path 334.

As described above, by rotating the paper path switch devices 40*a* and 40*b* to position the end "b" of the power dispenser 350*b* in the upper end "E" of the right paper moving path 334, the papers moved through the right paper moving path 334 are guided along the curved part 325*b* of the paper dispenser 350*b* to move to the lower paper moving path 332.

By contrast, if the papers move from the right paper moving path 334 to the upper paper moving path 331, as shown in FIG. 12*c*, the central shaft 344 connected with the shafts 343*a* and 343*b* is rotated clockwise at a predetermined angle by power transmission of the shaft gear 342 so that the end "a" of the power dispenser 350*a* is positioned in the lower end "E'" of the right paper moving path 334.

As described above, by rotating the paper path switch devices 40*a* and 40*b* to position the end "a" of the power dispenser 350*a* in the lower end "E'" of the right paper moving path 334, the papers moving through the right paper moving path 334 are guided along the curved part 325*a* of the paper dispenser 350*a* to move to the upper paper moving path 331.

In the description of the paper path switch devices according to the present invention, the pair of shafts 343*a* and 343*b* are respectively fitted into the paper dispensers 350*a* and 35*b*. However, if either small sized papers are provided or no problem occurs due to a frictional area of the paper dispensers when the papers are dispensed, the pair of shafts and the paper dispensers may be formed in a single body as shown in FIG. 13.

A method for controlling the aforementioned finishing apparatus according to the present invention will be described in more detail with reference to FIGS. 7 and 8.

The finishing apparatus 102 constructed by fixing the respective modules 10, 15, 20, and 16 to the paper conveyer module 40 is fixed to the copier 1, and then the system of the copier 1 is initiated in step S1.

The starting system of the first module (image tray) is checked in step S2. This is to check whether the first module is normally provided, and it is checked by signal exchange between the controller 51 and a CPU 52 if a functional key of the copier (not shown) is pressed.

If the first module is normally provided, detailed functions of the first module are checked by signal exchange between the controller 51 and the CPU 52 in step S3.

Then, the starting system and functions of the second module are checked in step S4 in the same manner as the first module.

Once checking the starting system and functions of the second module is completed in step S5, the signal of the copier 1 is synchronized with the signal of the first module in step S6 and the synchronized signal is transmitted to the copier in step S7.

Subsequently, the first module is initiated in step S8. Once initiating the first module is completed in step S9, the system returns to the second module in step S10.

In the second module, the steps S8 and S9 are repeated until the system returns to the last fourth module. Once the system returns to the fourth module in step S11, the controller 51 receives an operation command signal of the module selected from the CPU 52 of the copier 1 in accordance with the user's functional key control of the copier in step S12.

Then, the controller 51 controls the selected module in accordance with the received operation command signal in step S13.

As aforementioned, the finishing apparatus of the image forming apparatus and the method for controlling the same according to the present invention have the following advantages.

Various block modules performing finishing functions are detachably provided in the paper conveyer module which is detachably provided in the copier, so that the user can selectively use the respective modules. Thus, when the papers are caught between the paper conveyer module and the respective module or between the copier and the paper conveyer module in the process of moving the papers, it is possible to easily remove the caught papers.

In addition, since the paper path switch devices provided in the paper conveyer module include the paper dispensers each having an elliptical curved part on the pair of shafts rotating along the central shaft at a predetermined angle and a space between the shafts, the papers can be dispensed in three or more directions using one paper path switch device. This can prevent the volume of the apparatus from increasing due to a number of paper path switch devices.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A finishing apparatus which finishes papers ejected from an image forming apparatus comprising:

a plurality of paper processing modules;

a controller sensing whether the respective paper processing modules are detachably fixed to the image forming apparatus to transmit and receive functional signals of the respective modules to and from the image forming apparatus; and a paper conveyer module detachably fixed in the image forming apparatus, wherein the paper conveyer module includes a paper path switch device guiding the papers to the paper processing modules, and the paper patch switch device is turned on/off by a controller of the paper conveyer module, wherein the paper path switch device includes:

a rotational means of which rotational position is controlled by a position sensing means;

a pair of shafts connected with the rotational means and spaced apart in parallel from each other to rotate at a predetermined angle along a central shaft; and paper dispensers provided on the circumference of the shafts, each having an elliptical curved part arranged outwardly and the shafts provided with the paper dispensers being arranged in a position where a plurality of paper moving paths are divided.

2. The finishing apparatus according to claim 1, wherein the paper processing modules are comprised of one or more modules selected from:

an image tray module constructed to stack the papers ejected from the image forming apparatus through the paper conveyer module;

a mail box module selectively dispensing the papers ejected from the image forming apparatus into a plurality of bins;

a finisher module stapling or punching the papers ejected from the image forming apparatus to stack them on a stack tray; and a booklet module binding the papers ejected from the image forming apparatus to stack them on an eject tray.

3. The finishing apparatus according to claim 2, wherein each bin of the mail box module includes a bin flap guiding the papers moved through the paper conveyer module, and the bin flap is turned on/off by the controller of the paper conveyer module.

4. The finishing apparatus according to claim 1, wherein the paper conveyer module is constructed to detach the selected paper processing modules.

5. The finishing apparatus according to claim 1, wherein the rotational means includes a shaft gear fixed to the central shaft of the shafts and a motor rotating a worm gear engaged with the shaft gear.

6. The finishing apparatus according to claim 5, wherein the position sensing means includes a groove sensor fixed to the worm gear and a position sensor sensing the position of the groove sensor to control rotation of the motor so that the worm gear rotates at a predetermined angle.

7. The finishing apparatus according to claim 1, wherein the shafts rotating along the central shaft are arranged in such a way that plate shaped planes arranged in parallel oppose each other, and the paper dispensers are arranged along the shafts having the plate shaped planes.

8. The finishing apparatus according to claim 1, wherein the shafts have a "T" shape by forming a protrusion on the circumference of the plate shaped planes in a single body, and the paper dispensers are respectively fitted into the "T" shaped shafts.

9. The finishing apparatus according to claim 1, wherein the paper dispensers respectively fitted into the shafts are ejected in a single body with their respective shafts.

10. The finishing apparatus according to claim 1, wherein the plurality of paper processing modules are detachably connected to the paper conveyer module.

11. The finishing apparatus according to claim 1, wherein the paper processing modules are comprised of at least two modules selected from:

an image tray module constructed to stack the papers ejected from the image forming apparatus through the paper conveyer module;

a mail box module selectively dispensing the papers ejected from the image forming apparatus into a plurality of bins;

a finisher module stapling or punching the papers ejected from the image forming apparatus to stack them on a stack tray; and a booklet module binding the papers ejected from the image forming apparatus to stack them on an eject tray.

12. The finishing apparatus according to claim 1, wherein the paper conveyer module includes the controller.

* * * * *